US012357871B2

(12) United States Patent
Kordecki

(10) Patent No.: US 12,357,871 B2
(45) Date of Patent: Jul. 15, 2025

(54) ABDOMINAL EXERCISE DEVICE WITH TETHER ASSEMBLY FOR CONNECTION TO A RESISTANCE ASSEMBLY

(71) Applicant: Kormel LLC, Vernon Hills, IL (US)

(72) Inventor: Michael Kordecki, Vernon Hills, IL (US)

(73) Assignee: Kormel, LLC, Vernon Hills, IL (US)

( * ) Notice: Subject to any disclaimer, the term of this patent is extended or adjusted under 35 U.S.C. 154(b) by 218 days.

(21) Appl. No.: 18/086,761

(22) Filed: Dec. 22, 2022

(65) Prior Publication Data

US 2023/0131423 A1 Apr. 27, 2023

Related U.S. Application Data

(63) Continuation of application No. PCT/US2021/039387, filed on Jun. 28, 2021.

(60) Provisional application No. 63/044,779, filed on Jun. 26, 2020.

(51) Int. Cl.
*A63B 21/00* (2006.01)
*A63B 23/02* (2006.01)

(52) U.S. Cl.
CPC ..... *A63B 21/4035* (2015.10); *A63B 21/151* (2013.01); *A63B 23/0211* (2013.01)

(58) Field of Classification Search
CPC ..... A63B 21/4035; A63B 21/151; A63B 23/0211; A63B 21/062; A63B 21/055; A63B 21/0557; A63B 23/0205; A63B 65/06; A63B 21/4019
See application file for complete search history.

(56) References Cited

U.S. PATENT DOCUMENTS

D318,567 S * 7/1991 Smith ..... D7/901
5,085,320 A * 2/1992 Scott ..... A63B 47/007 206/315.9
5,230,682 A * 7/1993 Myers ..... A63B 21/0004 473/576
5,735,776 A * 4/1998 Swezey ..... A63B 21/0085 482/148
6,892,916 B1 * 5/2005 Rugg ..... A63B 47/00 224/605
D552,696 S * 10/2007 Hallar ..... D21/713
8,882,642 B2 * 11/2014 Chavez ..... A63B 23/03575 482/121

(Continued)

*Primary Examiner* — Andrew S Lo
(74) *Attorney, Agent, or Firm* — Barnes & Thornburg LLP

(57) ABSTRACT

The invention provides an exercise device used by a person to perform abdominal exercises, where the device comprises a weighted ball designed such that the user U can "single-hand drive" the ball through both the concentric portion and eccentric portion of the exercise movement without experiencing unwanted twisting motion of the ball while it is being held during performance of the abdominal exercises. A tether assembly includes a first tether segment and a second tether segment, both being affixed to an outer surface of the ball by a top connector assembly and a bottom connector assembly to define a first and second gaps. The top and bottom connectors are arranged 180 degrees apart and reside along a connector axis that extends through the center of the ball. A first coupler extends from the first tether segment and a second coupler extends from the first and second tether segments, respectively, for operable connection to the resistance assembly.

22 Claims, 15 Drawing Sheets

(56) References Cited

U.S. PATENT DOCUMENTS

| | | | | |
|---|---|---|---|---|
| 8,911,334 | B1 * | 12/2014 | Cotter | A63B 21/4005 482/111 |
| 9,211,464 | B2 * | 12/2015 | Francis | A63B 69/26 |
| 9,545,534 | B2 * | 1/2017 | Crandall | A63B 21/0601 |
| 9,616,269 | B1 * | 4/2017 | Burosh | A63B 21/0004 |
| 9,770,619 | B1 * | 9/2017 | Bullock | A63B 65/06 |
| 9,844,695 | B1 * | 12/2017 | Shorter | A63B 21/075 |
| 10,322,311 | B2 * | 6/2019 | Naomi | A63B 21/002 |
| 11,400,336 | B2 * | 8/2022 | Pasterino | A63B 21/00069 |
| D974,502 | S * | 1/2023 | Beall | D21/682 |
| 2009/0215593 | A1 * | 8/2009 | Ligrano | A63B 23/03508 482/121 |
| 2012/0149536 | A1 * | 6/2012 | Trimble | A63B 21/00065 53/469 |
| 2013/0085045 | A1 * | 4/2013 | Chavez | A63B 23/03575 482/93 |
| 2013/0267390 | A1 * | 10/2013 | Warren | A63B 21/075 482/93 |
| 2014/0256522 | A1 * | 9/2014 | Holt, IV | A63B 21/4035 482/110 |
| 2016/0051855 | A1 * | 2/2016 | Warren | A63B 23/1209 482/93 |
| 2017/0361173 | A1 * | 12/2017 | Buenning | A63B 43/02 |
| 2019/0111308 | A1 * | 4/2019 | Naomi | A63B 21/4011 |

* cited by examiner

ABDOMINAL EXERCISE DEVICE WITH TETHER ASSEMBLY FOR CONNECTION TO A RESISTANCE ASSEMBLY

PRIORITY CLAIM

The present application is a continuation of PCT Application Ser. No. PCT/US21/39387, which claims the benefit of U.S. Provisional Patent Application Ser. No. 63/044,779, the disclosure of which is hereby incorporated by reference in its entirety for all purposes.

TECHNICAL FIELD

This disclosure relates to a handheld exercise device used by a person to perform abdominal muscle exercises. The exercise device features a tether assembly that can be operably connected to a resistance assembly. The tether assembly includes at least one flexible segment affixed to an outer surface of the exercise device that defines a gap that the person inserts his/her hands through, and at least one coupler for operable connection to the resistance assembly. When the person inserts his/her hand(s) through the gap formed by the tether segment(s) and the coupler is connected to the resistance assembly, the person holds or cradles the exercise device stable, without gripping it, and then rotates his/her torso through a range of motion to train the abdominal muscles, where the resistance assembly increases the amount of work performed by the person during the exercise movement. The tether assembly ensures that forces generated by the resistance assembly remain properly focused and aligned with respect to the exercise device and the person holding it. As a result, the exercise device remains stable, balanced and resists uncomfortable twisting motion while being held by the person performing the abdominal exercises.

BACKGROUND

The muscles of the lateral aspect of the torso are especially difficult to isolate and strengthen. The lateral and anterior torso muscles of a person are part of a group of muscles commonly referred to as "abs" or "core muscles." More specifically, the primary muscles of the lateral and anterior torso are: (i) the internal obliques, (ii) the external obliques, (iii) the transverse abdominus and, (iv) the rectus abdominus. The primary functions of these muscles of the lateral and anterior torso are to provide support and protection of the person's internal organs such as the liver, intestines, kidneys, spleen, and reproductive organs of women. These muscles of the lateral and anterior torso also support and assist in movement of the rib cage. A secondary function of the internal and external obliques and transverse abdominus is to assist in movement of the torso, spine, and ribs and to a lesser degree, the task of respiration. As such, strong oblique and transverse abdominal muscles play a critical role in core stabilization and provide numerous health benefits.

A strong core allows a person to successfully perform a variety of athletic maneuvers, as well as daily activities, both correctly and efficiently while at the same time providing protection to the spine. In women, healthy and developed obliques and transverse abdominal muscles help support the uterus and decrease stress on the lumbar spine during pregnancy. In individuals with well-developed core muscles, a person's overall movement patterns of the shoulders and arms improve dramatically. Furthermore, well-conditioned core muscles create stability through the person's torso, which allows the shoulder blades to "lever off" or "lever from" a solid foundation. It is also well-documented in industry literature that a solid torso allows for correct synchronization between the upper arm bone (humerus) and shoulder blade (scapula) at the shoulder (glenohumeral) joint. Mechanically correct, efficient movement patterns at the glenohumeral joint create better arm and shoulder strength, as well as promote proper posture. Thus, strong oblique and transverse abdominal muscles provide a person with numerous, well-recognized benefits.

For years, individuals have sought an effective exercise in which to train the abdominal muscles, both as a group and individually. While there have been numerous exercises and pieces of exercise equipment that are promoted and marketed as strengthening the abdominal muscles, they suffer from numerous shortcomings and limitations. Accordingly, there is a longstanding, unmet need for exercise equipment or a device specifically designed to properly and effectively perform a torso rotation exercise to train and enhance strength of internal obliques, external obliques, transverse abdominus and abdominus muscles, collectively.

The description provided in the Background section should not be assumed to be prior art merely because it is mentioned in or associated with the background section. The Background section may include information that describes one or more aspects of the subject of the technology. A full discussion of the features and advantages of the device 10 presented in the following detailed description, which includes reference to the accompanying Figures.

BRIEF DESCRIPTION OF THE DRAWINGS

The figures depict one or more implementations in accord with the present teachings, by way of example only, not by way of limitation. In the figures, like reference numerals refer to the same or similar elements.

Figure 1:
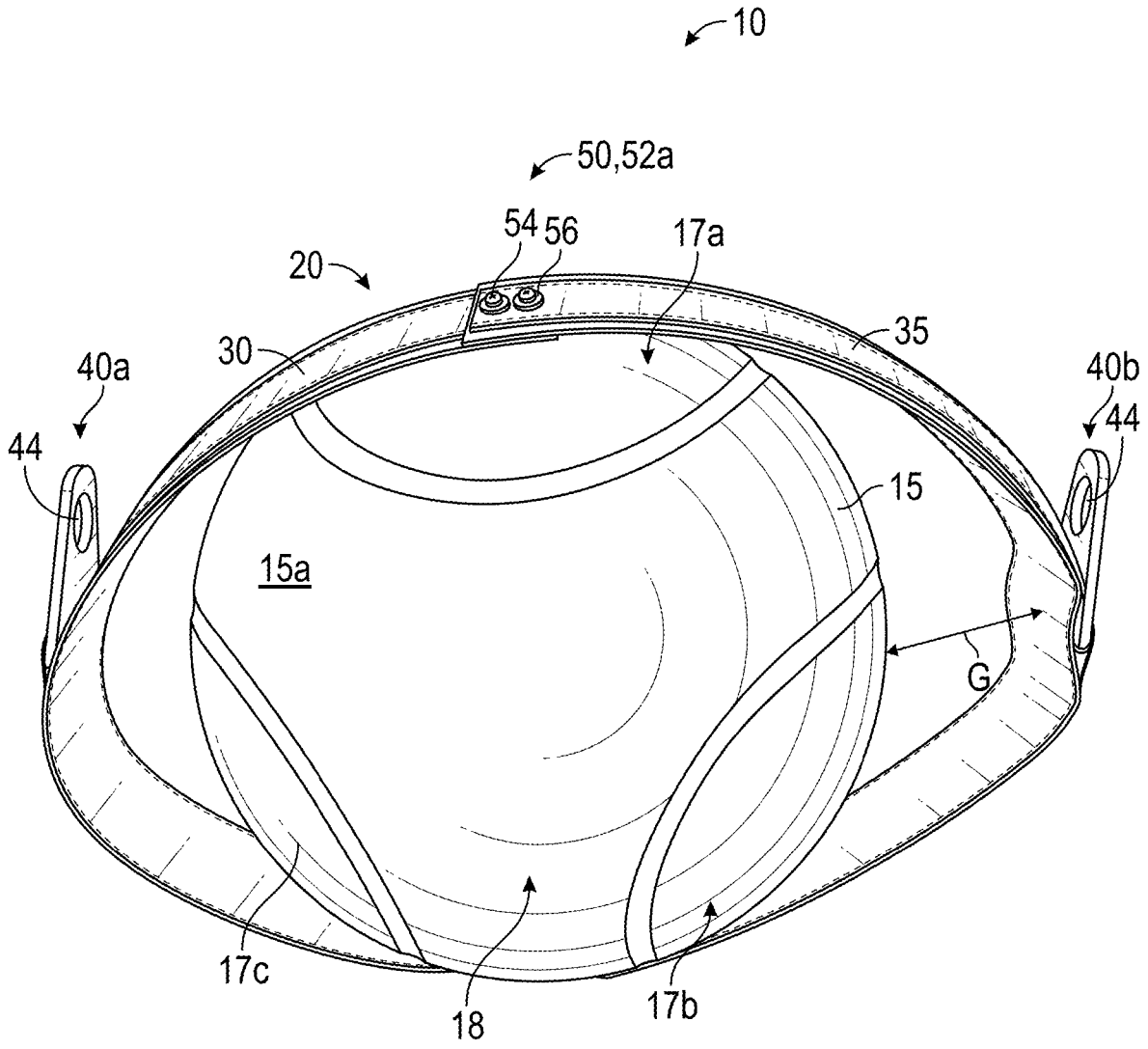
FIG. 1 is a perspective view of a first embodiment of an exercise device for performing a torso rotation movement in an unconnected, non-use position, the exercise device including a ball and a tether assembly coupled to said ball.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the figures, like reference numerals refer to the same or similar elements.

DETAILED DESCRIPTION

While this disclosure includes a number of details and implementations in many different forms, there is shown in the drawings and will herein be described in detail particular implementations with the understanding that the present disclosure is to be considered as an exemplification of the principles of the disclosed methods and systems, and is not intended to limit the broad aspects of the disclosed concepts to the implementations illustrated.

This disclosure, including the Figures, relates to an exercise devices 10, 1010, 2010, 3010 that can be used by a person or user to perform a wide variety of abdominal muscle exercises, namely the following exercises: standing rhythmic stabilization, supine Russian torso twists, standing chopping, one-half kneel chopping, standing diagonal chopping left and right, overhead side to side pull, standing single arm chop lifts, supine curl-ups straight, supine curl-ups diagonal right and left, supine curl-ups alternating right and left diagonal curl-ups. The exercise device 10, 1010, 2010, 3010 is preferably handheld by a person and features a flexible tether assembly 20, 1020, 2020, 3020 that can be operably connected to a resistance assembly 100. The tether assembly 20, 1020, 2020, 3020 includes at least one segment 30, 1030, 2030, 3030 affixed to the device 10, 1010, 2010, 3010 that forms a gap G that the person inserts his/her hand(s) H through, and at least one coupler 40, 1040, 2040, 3040 for operable connection to the resistance assembly 100. When the person inserts his/her hand(s) H through the segment 30, 1030, 2030, 3030 and the coupler 40, 1040, 2040, 3040 is connected to the resistance assembly 100, the person then rotates his/her torso through a range of motion to train the abdominal muscles, where the resistance assembly 100 increases the amount of work performed by the person during the exercise.

Referring to FIGS. 1-8, the first embodiment of the exercise device 10 includes a spherical ball 15 and a tether assembly 20. The spherical ball 15 may have a rigid outer surface 15*a* or an elastically deformable outer surface 15*a*, which may be configured to aid the person in grasping the device 10. The spherical ball 15 includes three optional textured segments 17*a*, 17*b*, 17*c* and a central portion 18. The three optional textured segments 17*a*, 17*b*, 17*c* are configured to provide an increased level of friction between the person's hands H and the ball 15. The central portion 18 may not be textured and may include a region for indicia and labeling. Such indicia or labeling may indicate the manufacturer of the ball 15, the diameter of the ball 15 and/or the weight of the ball 15. The ball 15 may have a diameter between 3-36 inches and preferably between 8-12 inches. Additionally, the ball 15 may have a weight between 0.5 pounds and 20 pounds, preferably between 1 pound and 10 pounds, and most preferably between 4 pounds and 12 pounds. It should be understood that the device 10 shown in FIGS. 1-8 is symmetric along both: (i) a vertical axis $A_V$ that extends between a top pole 13*a* and a bottom pole 13*b* and is perpendicular with a horizontal axis $A_H$ and (ii) the horizontal axis $A_H$ that extends a leftmost point 13*c* and the rightmost point 13*d*. Because the device 10, namely the ball 15 and the tether assembly 20, is symmetric a person suitably skilled in the art of designing exercise equipment recognizes that the front view shown in FIG. 2 matches a rear view (not shown) of the device 10, the top view shown in FIG. 3 matches a bottom view (not shown) of the device 10, and the side view shown in FIG. 4 matches the opposed side view (not shown) of the device 10. Thus, it is not necessary for the Figures to include a rear view, bottom view or second side view of the device 10. It should be understood that in other embodiments, the device 10 may not be symmetric about both axes and instead may only be symmetric along one axis. In further embodiments, the device 10 may not be symmetric along any axis.

Figure 2:
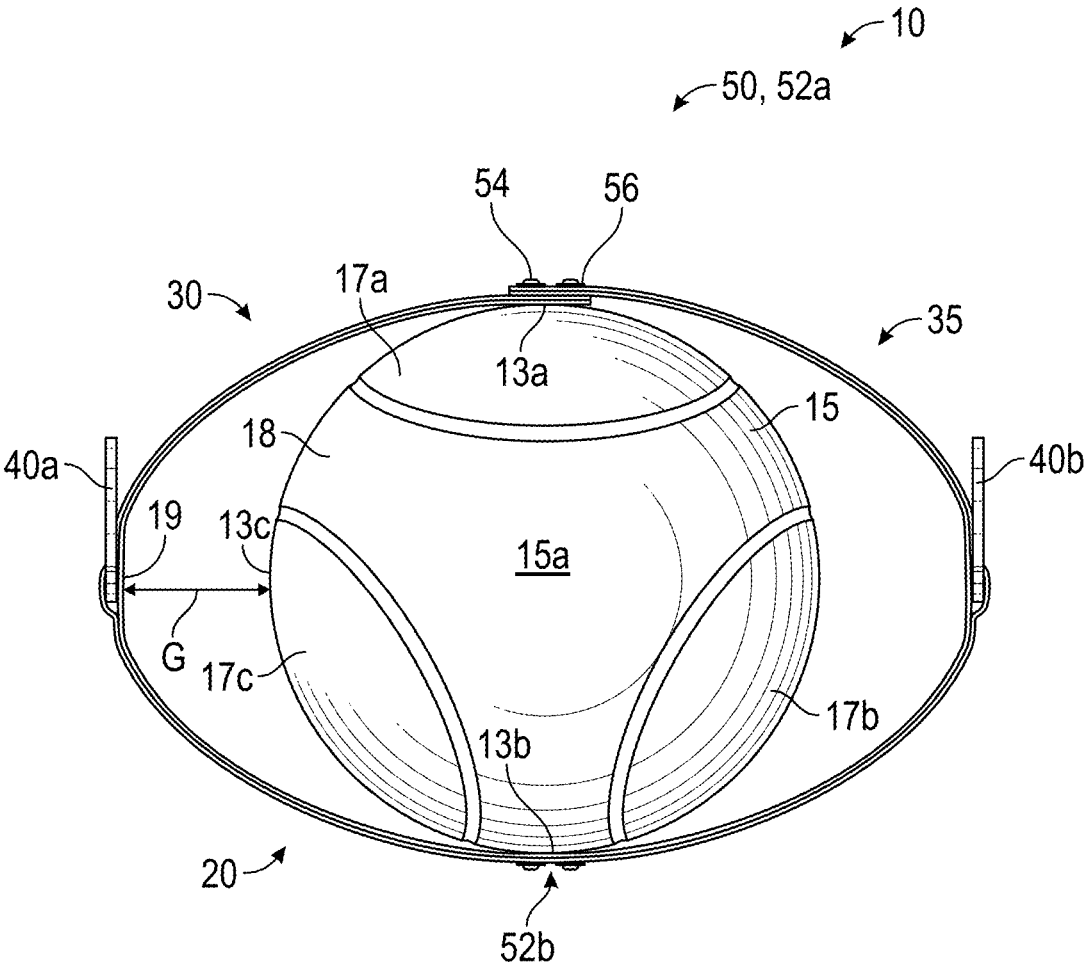
FIG. 2 is a front view of the exercise device of FIG. 1.
Figure 3:
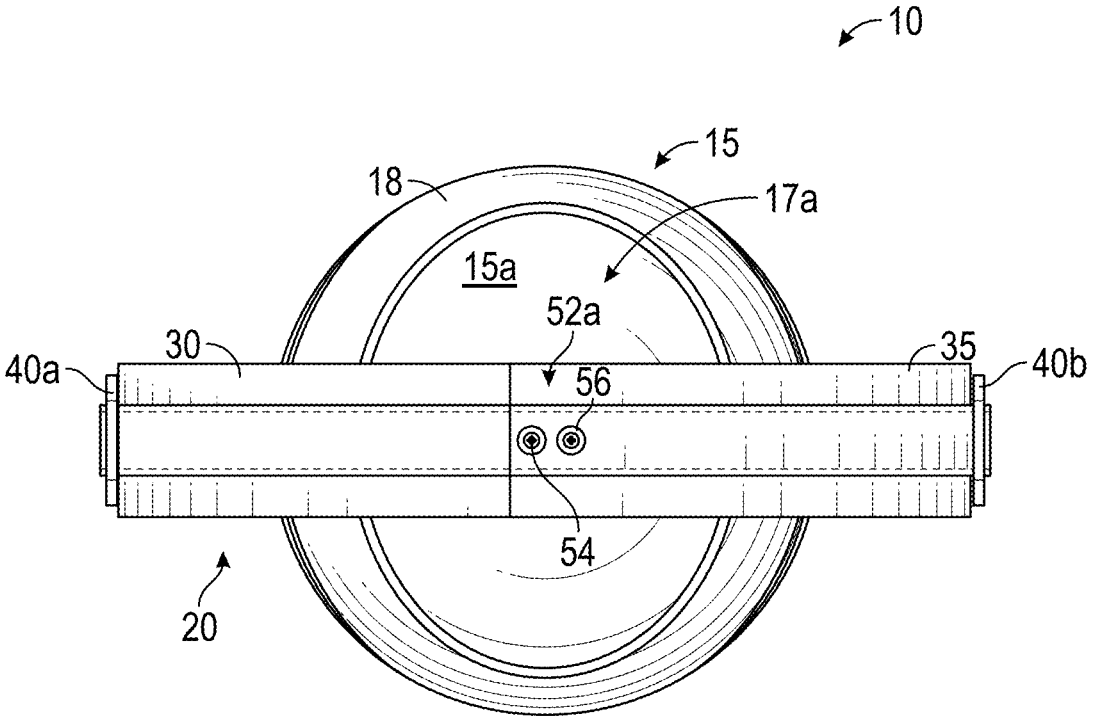
FIG. 3 is a top view of the exercise device of FIG. 1.
Figure 4:
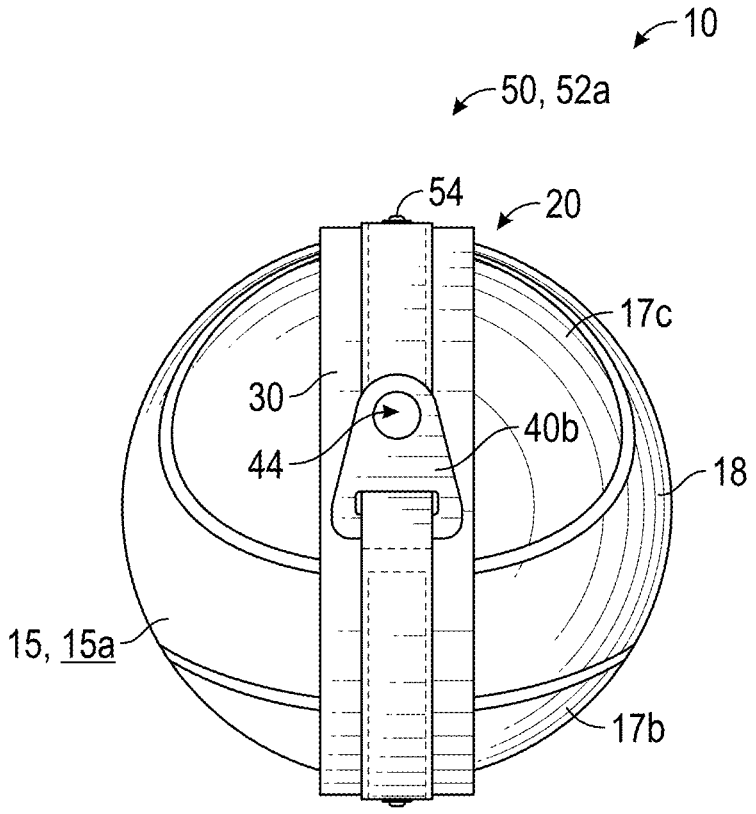
FIG. 4 is a side view of the exercise device of FIG. 1.
Figure 5:
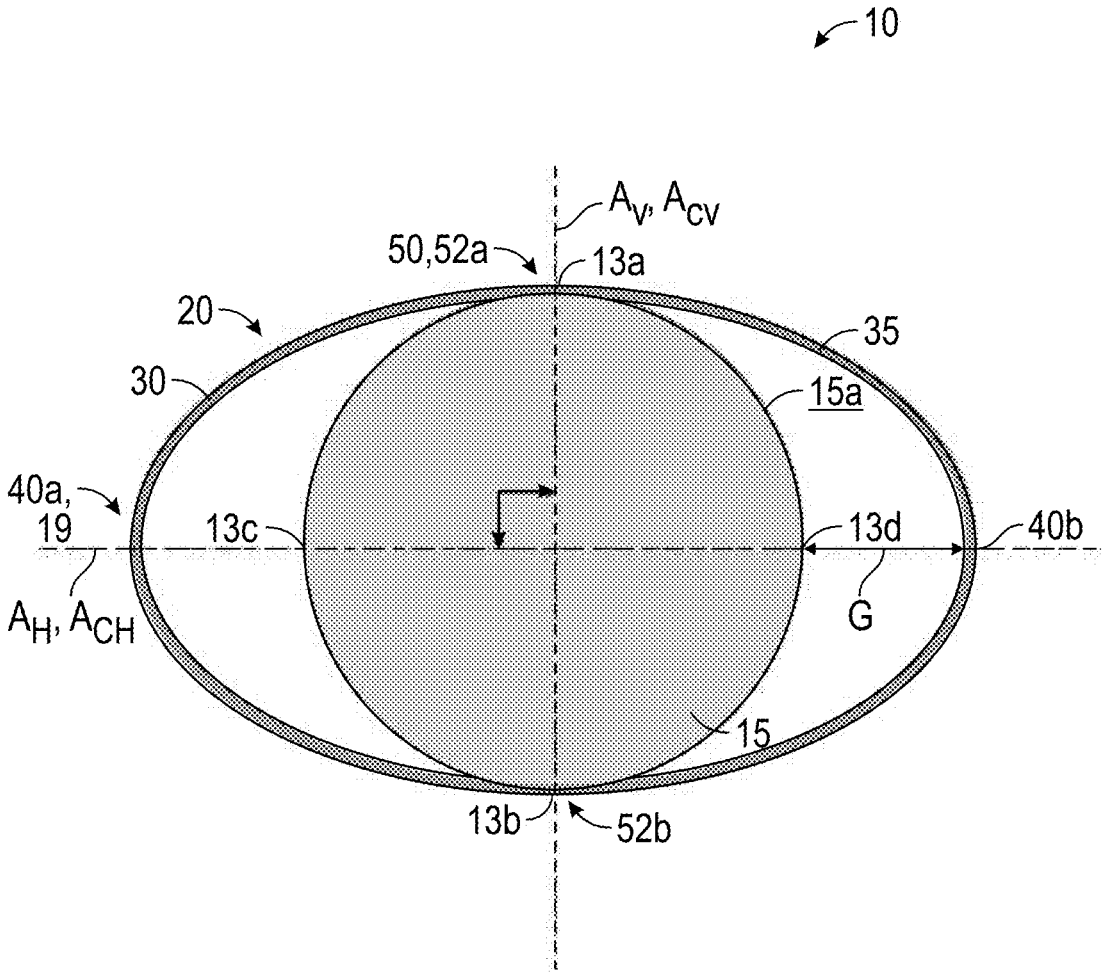
FIG. 5 is a schematic view of the exercise device of FIG. 1.

In the embodiment of FIGS. 1-8, the tether assembly 20 spans the circumference of the ball 15 and is affixed to at least one exterior location of the ball 15 by a fastening mechanism 50. The fastening mechanism 50 includes at least one, and preferably two connector assemblies 52*a*, 52*b* that are positioned at the poles 13*a*, 13*b* of the ball 15. Each connector assembly 52*a*, 52*b* is comprised of at least one fastener 54 (e.g., elongated screw) that extends through an extent of the tether assembly 20 and into the ball 15 and at least one washer 56. As shown in FIGS. 2, 3 and 5, the connector assemblies 52*a*, 52*b* are substantially aligned with the vertical axis $A_V$, which is oriented perpendicular to a horizontal axis $A_V$ defined through the coupler(s) 40*a*, 40*b*. An upper connector assembly 52*a* is located in a twelve o'clock position and a lower connector assembly 52*b* is located in a six o'clock position, whereby the assemblies 52*a*, 52*b* are in an opposed positional relationship. Preferably, the connector assemblies 52*a*, 52*b* includes two fasteners 54 and two washers 56, wherein the vertical axis $A_V$ is positioned between said fasteners 54 and washers 56. The connector assemblies 52*a*, 52*b* are in an opposed positional relationship of the ball 15, which means that a pair of the connector assemblies 52*a*, 52*b* are oriented 180 degrees apart from another pair of the connector assemblies 52. In alternative embodiments, the connector assemblies 52*a*, 52*b* may: (i) include only a single fastener 54 and a single washer 56, (ii) include more than two fasteners 54 and washers 56, (iii) omit the washers 56 and may include one or more fasteners 54, or (iv) may omit the fastener(s) 54 and washer(s) 56 and utilize other known methods of permanently coupling two items to one another (e.g., high-strength glue, bonding substances, sewing) or (v) may utilize any known method of releasable coupler (e.g., quarter-turn, bayonet connector).

Figure 6:
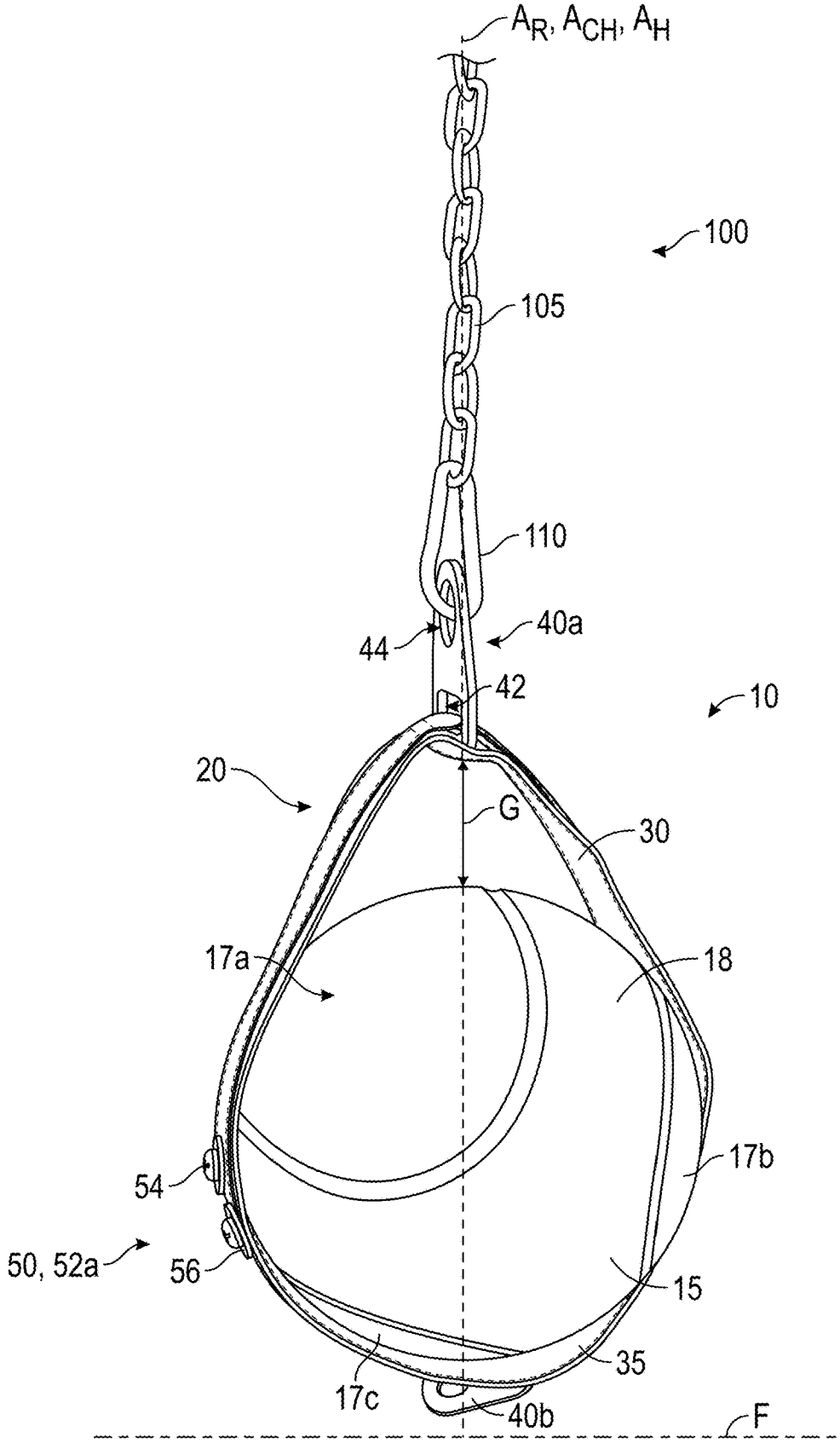
FIG. 6 is a perspective view of the exercise device of FIG. 1 connected to a resistance assembly, showing the device in a connected, non-use position.
Figure 7:
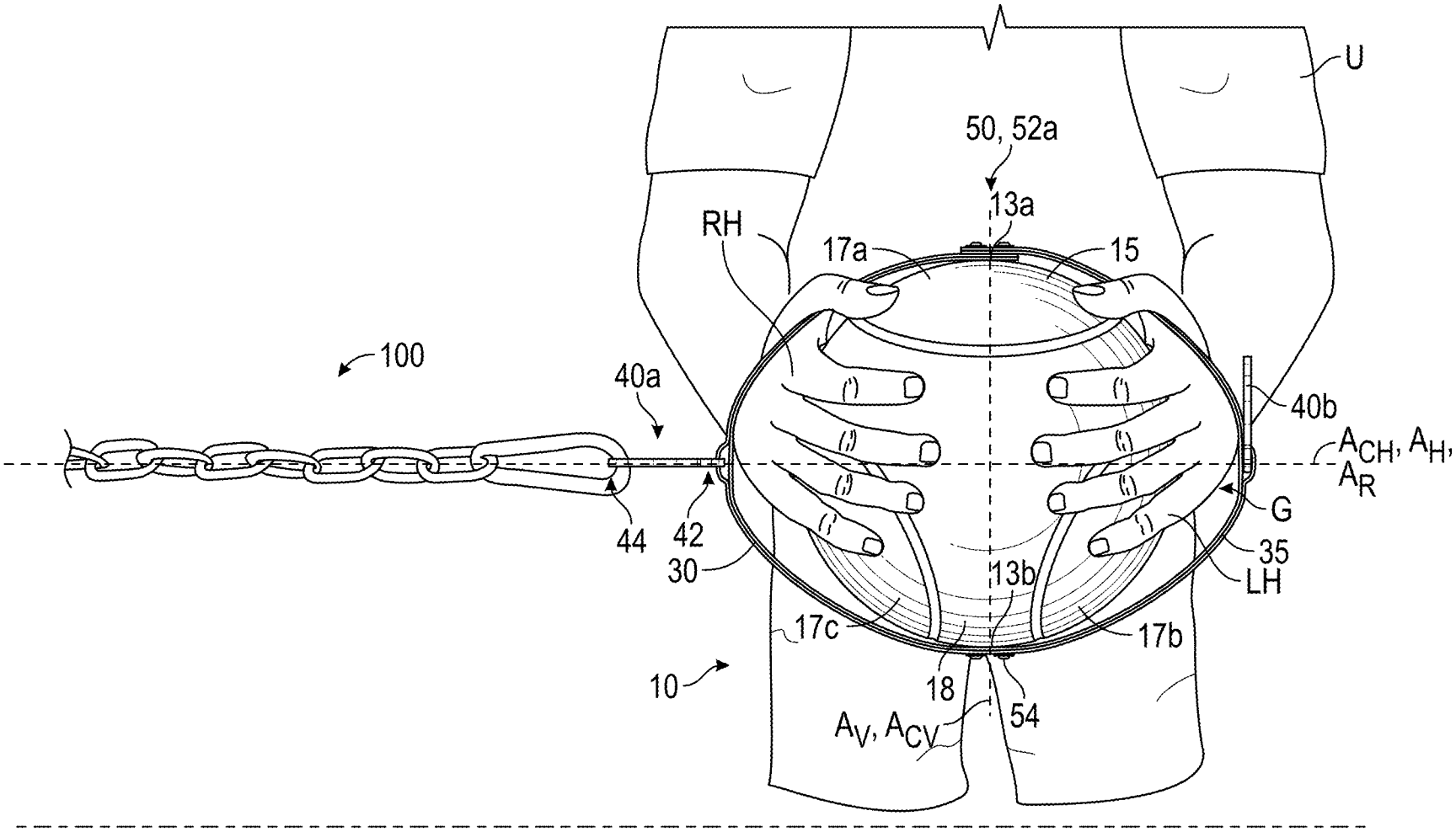
FIG. 7 is a perspective view of the exercise device of FIG. 1 in a connected, ready to use position where: (i) the exercise device is connected to the resistance assembly, (ii) the person's hands are inserted through a gap formed by the tether assembly and grasping the exercise device, and (iii) the person's torso is in an initial, neutral position.
Figure 8:
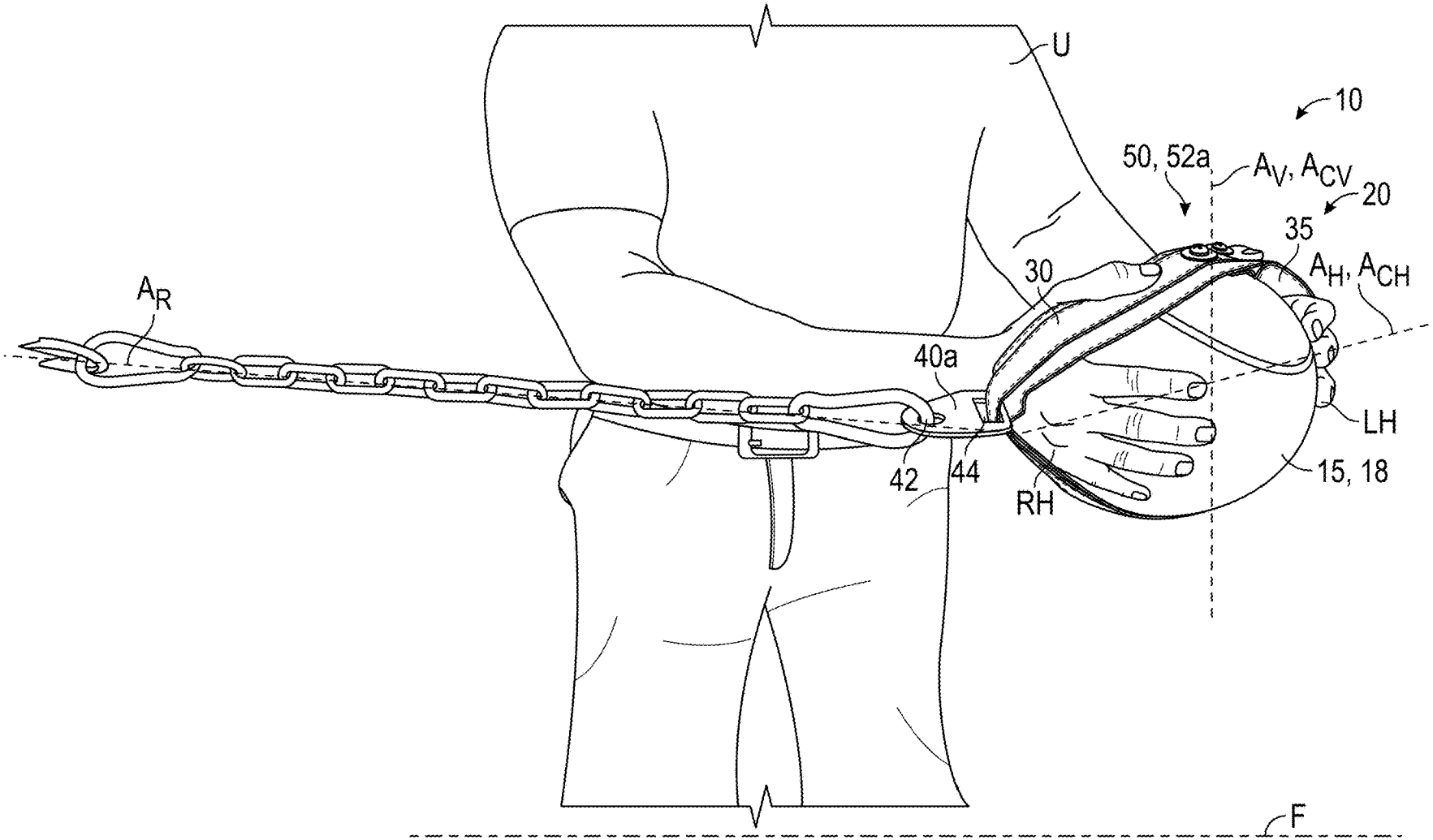
FIG. 8 is a perspective view of the exercise device of FIG. 1 in a connected, use position where (i) the exercise device is connected to the resistance assembly, (ii) the person's hands are inserted through the gap formed by the tether assembly and grasping the exercise device and (iii) the person's torso is in an extended, rotated position.
Figure 9:
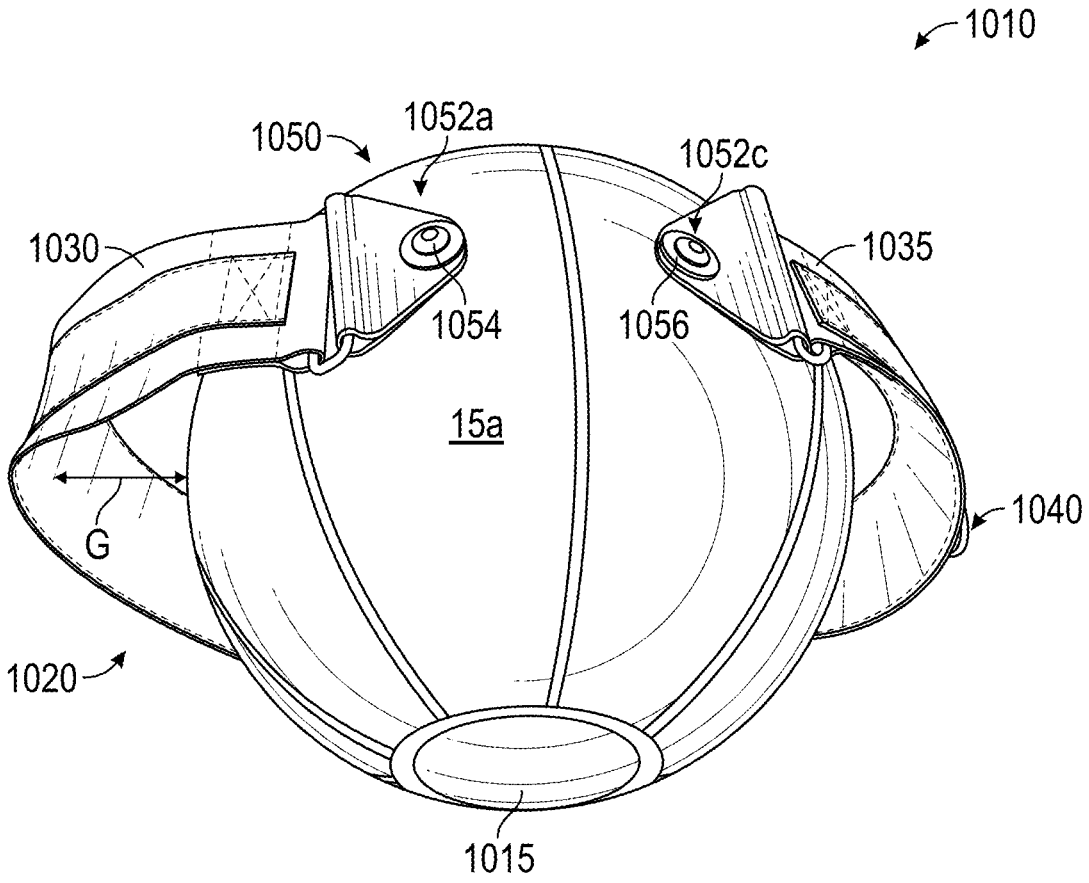
FIG. 9 is a perspective view of a second embodiment of an exercise device for performing a torso rotation movement in an unconnected, non-use position, the exercise device includes a ball and a tether assembly coupled to said ball.
Figure 10:
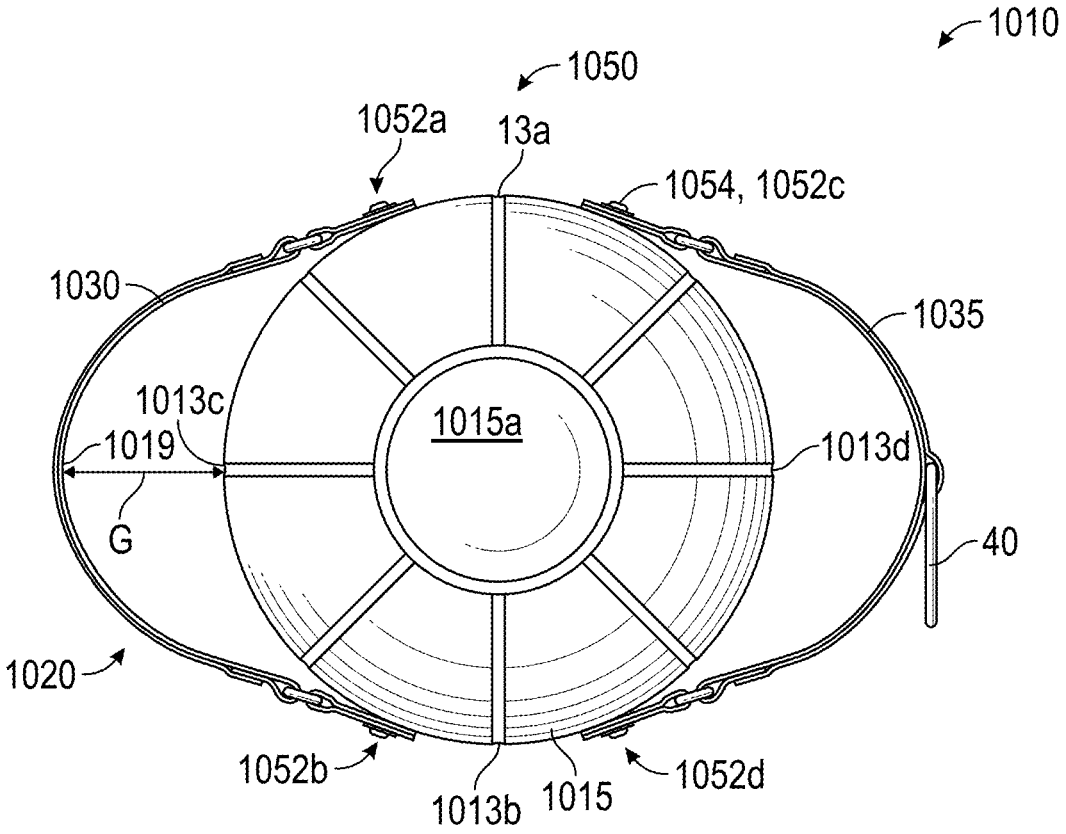
FIG. 10 is a front view of the exercise device of FIG. 9.
Figure 11:
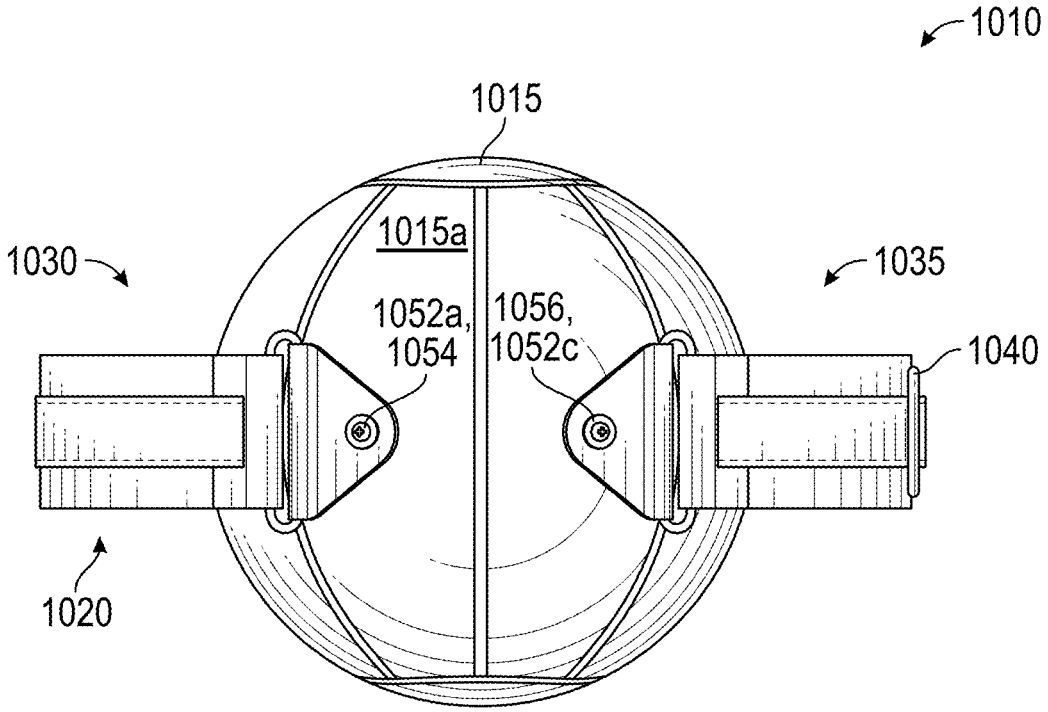
FIG. 11 is a top view of the exercise device of FIG. 9.
Figure 12:
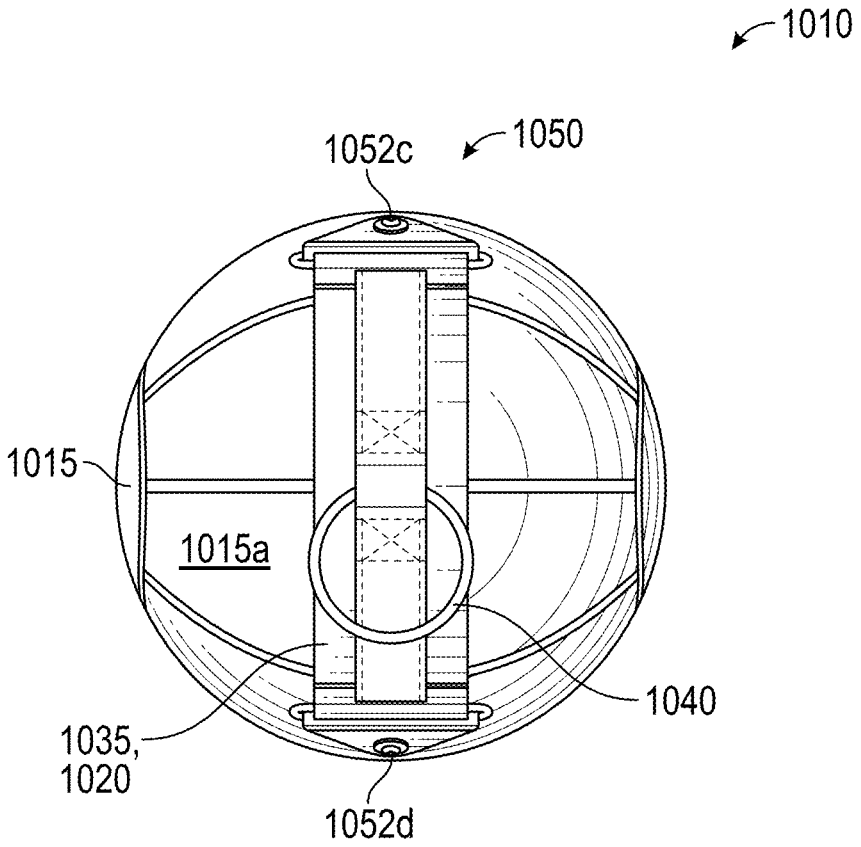
FIG. 12 is a side view of the exercise device of FIG. 9.
Figure 13:
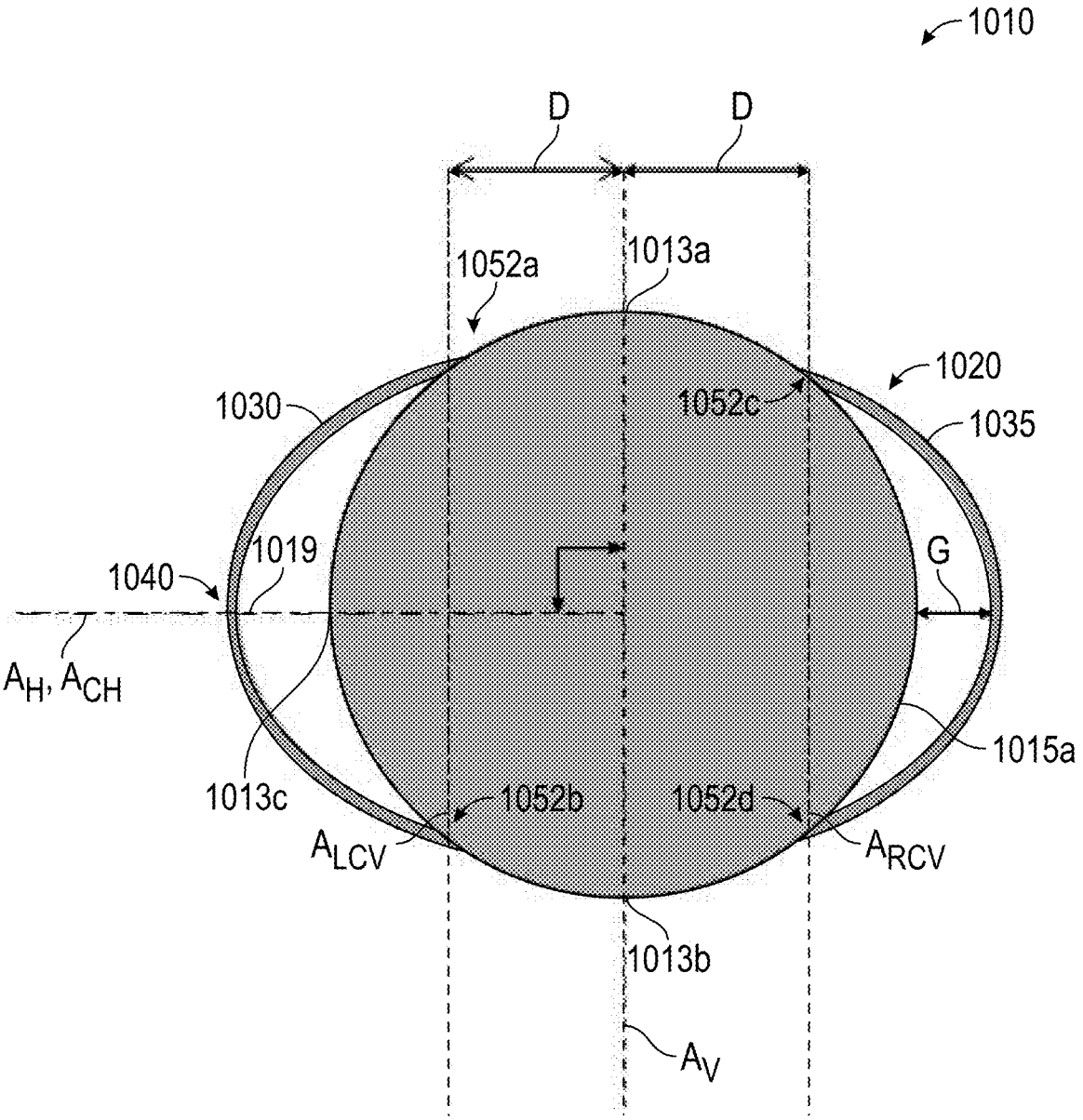
FIG. 13 is a schematic view of the exercise device of FIG. 9.

Due to the arrangement of the tether assembly 20 and the fastening mechanism 50, the tether assembly 20 features at least one tether segment, preferably two tether segments 30, 35, each of which span a substantial extent, namely a hemisphere, of the ball 15. Referring to FIGS. 2-5 and with a frame of reference that extends outward from the drawing sheet (which corresponds to the orientation of the user U in FIGS. 7 and 8), a right or first tether segment 30 is in an opposed positional relationship with a left or second tether segment 35. The tether segment 30, 35 is dimensioned with a suitable arc length to extend outward of or flare beyond the outer periphery of the ball 15 to define a gap G between the tether segment 30, 35 and an outer surface 15*a* of the ball 15. For example, the circumference of the ball 15 shown in FIGS. 1-8 is approximately 23.5 inches and the length of the tether assembly 20 is approximately 29.5 inches. The gap G that is configured to be large enough to allow the person or user of the ball 15 to inserts his/her hand H through, as shown in FIGS. 7-8. The gap G has a dimension of 1-4 inches, preferably 2-3 inches, at midpoint point 19 of the tether segment 30, 35 which is located the furthest distance away from the outer ball surface 15*a*. The person's hand H can be positioned such that his/her thumb resides against an outer surface of the tether segment 30, 35, while the other fingers of the hand H reside against the outer surface 15*a* of the ball 15 and within the gap.

As shown in FIGS. 1-8, the exercise device 10 includes at least one coupler 40*a*, 40*b* connected to an outer extent of the tether assembly 20. Specifically and as shown in FIG. 5, the couplers 40*a*, 40*b* are connected to the tether assembly 20 at: (i) the middle of the tether segments 30, 35, (ii) the midpoint 19 of the tether segments 30, 35 that are positioned furthest away from the outer surface 15*a* of the ball 15, (iii) the midpoint of the diameter of the ball 15, wherein the diameter of the ball 15 is co-linear with the horizontal axis $A_H$, (iv) the midpoint of the distance between the fastening mechanism 50. As such, a coupler axis $A_{CH}$ extends between the couplers 40*a*, 40*b* and through the center of the ball 15. The coupler axis $A_{CH}$ is co-linear with the horizontal axis $A_H$ and is positioned substantially perpendicular to the vertical axis $A_V$ and a connector axis $A_{CV}$ that extends between the two connector assemblies 52*a*, 52*b*. In this embodiment, the intersection between the coupler axis $A_{CH}$ and the connector axis $A_{CV}$ occurs at the center or origin of the ball 15. In other words, the coupler 40*a*, 40*b* are positioned at a location that is approximately 90 degrees from either one of the connector assemblies 52*a*, 52*b* and at the furthest point away from the connector assemblies 52*a*, 52*b*. Referring to FIGS. 2-5 and with a frame of reference that extends outward from the drawing sheet (which corresponds to the orientation of the user U in FIGS. 7 and 8), a right or first coupler 40*a* is located in a nine o'clock position and a left or second coupler 40*b* is located in a three o'clock position, whereby the couplers 40*a*, 40*b* are in an opposed positional relationship. Accordingly, the upper connector assembly 52*a* is located in the twelve o'clock position, the left coupler 40*b* is located substantially 90 degrees from the upper connector assembly 52*a* in the three o'clock position, the lower connector assembly 52*b* is located substantially 90 degrees from the left coupler 40*b* in the six o'clock position, and the right coupler 40*a* is located substantially 90 degrees from the lower connector assembly 52*b* in the nine o'clock position which is also substantially 90 degrees from the upper connector assembly 52*a*.

As shown in FIGS. 1-4 and 6-8, the tether segment 30, 35 extends through a first opening or slot 42 in the coupler 40*a*, 40*b* and the coupler 40*a*, 40*b* includes a second opening or slot 44 that receives an extent of the resistance assembly 100. The tether segments 30, 35 can include inner and outer layers, where the outer layer is fed through the first opening or slot 42. The coupler 40*a*, 40*b* can pivot approximately 180 degrees about the segment 30, 35; however, the tether segments 30, 35 are designed to retain the coupler 40*a*, 40*b* in a relatively stable location that prevents the coupler 40*a*, 40*b* from sliding beyond the midpoint of the segment 30, 35 and along the length of the segment 30, 35. In other embodiments, the coupler 40*a*, 40*b* may be: (i) integrally formed with the tether segment 30, 35, (ii) permanently coupled to the tether segment 30, 35 using another known method (e.g., glue/adhesive or fastener), or (iii) releasably coupled to the tether segment 30, 35.

Because the tether assembly 20 of the ball 15 includes two tether segments 30, 35 and two couplers 40*a*, 40*b*, the ball 15 features "bi-directional" connectivity with the resistance assembly 100. This bi-directional connectivity means the user can quickly and easily connect either side of ball 15 to the resistance assembly 100 for use in training both sides—the left and right sides—of the user's torso and abdominal muscles, regardless of how the user is located with respect to the resistance assembly 100. The two tether segments 30, 35 also ensure that the ball 15 is balanced and not susceptible to undesirable horizontal and/or vertical motion (e.g., a twisting or drifting motion) while being held by the person performing the abdominal exercises. In another embodiment, exercise device includes only one coupler, which in turn provides "uni-directional" connectivity with the resistance assembly 100. In this alternate embodiment, the complexity of ball is reduced, which can reduce the manufacturing costs of the alternate ball.

FIG. 5 shows the device 10 in a connected, non-use position, wherein the ball 15 hangs freely from the resistance assembly 100 and the coupler 40*a*, 40*b* is releasably secured to the resistance assembly 100, but not yet engaged by a person for the performance of the abdominal exercises. In this non-supported, connected, non-use position, the ball 15 is not supported by the floor or a support surface and instead hangs freely from the resistance assembly 100 which may be connected to a machine (not shown) having a stack of selectable weights. In this position and also referring to FIG. 5, the coupler 40*a*, 40*b* is: (i) substantially perpendicular to: (a) the connector axis $A_{CV}$, (b) the vertical axis $A_V$, and (c) the floor F or support surface upon which the person/user stands and the exercise machine rests, and (ii) substantially parallel to: (a) coupler axis $A_{CH}$, (b) horizontal axis $A_H$, and (c) a resistance assembly axis $A_R$ (shown in FIGS. 5-7) that extends along an extent of the resistance assembly 100. Additionally, in this connected, non-use position both of the vertical axis $A_V$ and connector axis $A_{CV}$ are positioned substantially parallel with the floor F and substantially perpendicular with the resistance assembly axis $A_R$. Further, in this connected, non-use position, both the horizontal axis $A_H$ and the coupler axis $A_{CH}$ are positioned substantially perpendicular with the floor F and co-linear with the resistance assembly axis $A_R$.

It should be understood that other connected, non-use positions are contemplated by this disclosure, wherein the positional relationships discussed above in connection with FIG. 6 may not apply. For example, the device 10 may be in a supported, connected, non-use position, wherein the device 10 is supported by the floor or support surface. In this supported, connected, non-use position, the coupler axis $A_{CH}$ may be positioned substantially parallel with the floor F and the connector axis $A_{CV}$ may be positioned substantially perpendicular to the floor F. Additionally, the coupler 40*a*, 40*b* may be angled and not perpendicular or parallel with any other structure.

The resistance assembly 100 may be any known device or structure that can provide resistance on the device 10 during usage of the ball 15, such as pivotal torso movement by the user. For example and as shown in FIGS. 6-8, the resistance assembly 100 may be an exercise machine with a selectable weight stack, a chain 105, and a carabineer 110, wherein the carabineer 110 releasably couples the coupler 40*a*, 40*b*, and in turn the device 10, to the exercise machine. Said exercise machine may be the machine disclosed within PCT/US21/

37219, which is fully incorporated herein by reference for all purposes. In other embodiments, the resistance assembly 100 may be an elongated member (e.g., TRX system) or a deformable structure (e.g., strap, band, tube, or rope), wherein said deformable structure provides elastic resistance. In further embodiments, the resistance assembly 100 may include weight plate(s), a selectable weight stack, chain(s), hydraulic assembly, pneumatic assembly, spring(s), magnetic assembly, or any combination of the same. For example, the resistance assembly 100 may include a combination of weight plate(s) and elastically deformable members.

As mentioned above, the exercise devices 10 can be used by a person or user to perform a wide variety of abdominal muscle exercises (see the listing above). FIGS. 7 and 8 show the user U performing a torso twist exercise (either standing or kneeling). FIG. 7 shows the exercise device 10 in a connected, "ready to use" position where (i) the ball 15 is connected to the resistance assembly 100, (ii) the hands H of the person or user U are inserted through the opposed tether segments 30, 35 and the gaps G to grasp the ball 15, and (iii) the person's torso is in an initial, neutral, non-rotated position. In the ready to use, which precedes the commencement of the torso rotation or pivoting movement, the user's right hand H is located between the coupler 40*a* and the ball 15 and oriented towards the resistance assembly 100 whereby the user can perform exercises in an opposite direction—in this instance, left torso pivotal movements. Also, in the ready to use position, the person's forearms extend away from the person's torso at a substantially 90 degree angle from the person's torso. In other words, the person's forearms are extended and oriented substantially perpendicular to the person's spinal column while holding the ball 15 steady and stable. Further, in the ready to use position, both the horizontal axis $A_H$ and the coupler axis $A_{CH}$ may be oriented substantially parallel to the floor F and co-linear with the resistance axis $A_R$. Also, both the vertical axis $A_V$ and the connector axis $A_{CV}$ may be oriented substantially perpendicular to both the floor F and resistance axis $A_R$. In other situations that are not shown in FIG. 7: (i) the coupler axis $A_{CH}$ may be angled relative to the floor F and/or the resistance axis $A_R$, (ii) the connector axis $A_{CV}$ may be angled relative to the floor F, (iii) the horizontal axis $A_H$ may be angled relative to the floor F and/or the resistance axis $A_R$, and/or (iv) the vertical axis $A_V$ may be angled relative to the floor F.

FIG. 8 shows the exercise device 10 in a connected, "use position" where: (i) the ball 15 is connected to the resistance assembly 100, (ii) the person's hands H are inserted through the opposed tether segments 30, 35 and into the gaps G to grasp the ball 10, and (iii) the person has at least partially rotated or pivoted their torso. In particular, FIG. 8 shows a specific use position, wherein the exercise device 10 in an "extended position," as the person's torso is in an extended and fully rotated position. Ideally, the range of motion of the torso movement is approximately 90 degrees from the center or neutral position (of FIG. 7) as the user U performs the movement(s) on either his/her left or right side. When the ball 15 is moved through the pivotal torso movement, the coupler 40*a* remains in a substantially stable position with respect to the tether segment 30, 35 which helps prevent unwanted and uncomfortable twisting motion of the ball 15 while it is being held by the person performing the abdominal exercises.

While in the use position, both of the horizontal axis $A_H$ and the coupler axis $A_{CH}$ may be oriented substantially parallel to the floor F and both of the vertical axis $A_V$ and the connector axis $A_{CV}$ may be oriented substantially perpendicular to the floor F. Further, in various states of movement (i.e., when the person has rotated between 1 degree and 90 degrees) between the ready to use position and the use position, both of the horizontal axis $A_H$ and the coupler axis $A_{CH}$ may be co-plainer with the resistance axis $A_R$, but will not be co-linear with the resistance axis $A_R$. In other situations that are not shown in FIG. 8: (i) the coupler axis $A_{CH}$ may be angled relative to the floor F and/or the resistance axis $A_R$ and (ii) the connector axis $A_{CV}$ may be angled relative to the floor F. In other words, the (i) the coupler axis $A_{CH}$ and resistance axis $A_R$ may not be oriented substantially parallel to the floor F, and (ii) connector axis $A_{CV}$ may not be oriented substantially perpendicular to the floor F. For example, an inner angle formed between the coupler axis $A_{CH}$ and the floor F may be between 1 degree and 90 degrees, and preferably less than 45 degrees.

In FIGS. 7 and 8, the person performs the pivotal torso movement to his/her left where his right hand RH and right elbow are closest to the coupler 40*a* secured to the resistance assembly 100. Upon completion of a suitable number of repetitions, the person can remove his/her hands H from the gaps G and then reorient himself by walking around the resistance assembly 100 such that his/her left hand LH and left elbow are closest to the coupler 40*b* secured to the resistance assembly 100 whereupon the person is in the ready to use position for the pivotal torso movement to his/her right. Thus, when the person performs the pivotal torso movement to his/her left, the right hand RH (i) is oriented towards the resistance assembly 100, and (ii) applies a compressive force on the outer ball surface 15*a* that is directed towards the person's left side and away from the resistance assembly 100 and the coupler 40*a* to move or "drive" the ball 15 to his/her left, while the left hand LH is the "off-hand" that does not drive the ball 15 and thus is oriented away from the resistance assembly 100 and does not apply a compressive force. As a result, the left hand LH can be removed from the ball 15 such that only the right hand RH remains in contact with the ball 15 to (i) and creates provide the driving force for the concentric portion of the exercise movement, and (ii) provide the resistance force on the eccentric portion of the exercise movement. Accordingly, the device 10 is designed—namely the position and orientation of the tether assembly 20, the fastening mechanism 30, the coupler(s) 40*a* and the resistance assembly 100—such that the user U can "single-hand drive" the ball 15 through the concentric portion (when the muscles contract) and eccentric portion (when the muscles lengthen or elongate) of the exercise movement. In this manner, the off-hand can be removed from the ball 15 without negatively impacting the performance of the exercise movement. When the person is performing the pivotal torso movement to his/her right, the left hand LH (i) is oriented towards the resistance assembly 100, and (ii) applies a compressive force on the outer ball surface 15*a* that is directed towards the person's right side and away from the resistance assembly 100 and the coupler 40*b* to move or "drive" the ball 15 to his/her right, while the right hand RH is the "off-hand" that does not drive the ball 15 and thus is oriented away from the resistance assembly 100 and does not apply a compressive force. As a result, the right hand RH can be removed from the ball 15 such that only the left hand LH remains in contact with the ball 15 and creates the driving force for the concentric portion of the exercise movement, as well as creating the resistance force on the eccentric portion of the exercise movement.

While performing repetitions of the abdominal exercise throughout the use position, the person's forearms remain extended away from the person's torso at a substantially 90 degree angle from the person's torso. Also, the person's forearms are extended and oriented substantially perpendicular to the person's spinal column while holding or cradling the ball 15, without firmly gripping it, steady and stable to focus the work on the person's abdominal muscles.

A second embodiment of the device 1010 is shown in FIGS. 9-13, which is similar to the first embodiment of the device 10 shown in FIGS. 1-8. For sake of brevity, the above disclosure in connection with device 10 will not be repeated, but it should be understood that across embodiments like reference numbers represent like structures and components of the devices 10, 1010. For example, the disclosure relating to ball 15 applies in equal force to ball 1015. Like the first embodiment of the device 10, this second embodiment of the device 1010 is symmetric along both: (i) the vertical axis $A_V$ and (ii) the horizontal axis $A_H$. Because the device 1010 is symmetric, the front view shown in FIG. 10 matches a rear view (not shown) of the device 1010, the top view shown in FIG. 11 matches a bottom view (not shown) of the device 1010, and the side view shown in FIG. 12 matches the opposed side view (not shown) of the device 1010. Thus, it is not necessary for the Figures to include a rear view, bottom view or second side view of the device 1010.

The major differences between the first and second embodiments of the device 10, 1010 include: (i) the tether assembly 1020 in the second embodiment not spanning the circumference of the ball 1015, (ii) the connector assemblies 1052 are not positioned at the top and bottom poles 13*a*, 13*b* of the ball 15, (iii) the connector assemblies 1052 are not co-linear with the vertical axis $A_V$, and (iv) the geometry of the couplers 1040 are different. As shown in the schematic view of FIG. 13, the left two connector assemblies 1052*a*, 1052*b* are aligned along a left connector axis $A_{LCV}$ and the right two connector assemblies 1052*c*, 1052*d* are aligned along a right connector axis $A_{RCV}$, where the left connector axis $A_{LCV}$ and right connector axis $A_{RCV}$ are positioned a predefined distance D away or offset from the vertical axis $A_V$. Due to the offset of this predefined distance D, the left and right connector axis $A_{LCV}$, $A_{RCV}$ do not extend through the center of the ball 15 and are not co-linear with the vertical axis $A_V$. Nevertheless, the left and right connector axis $A_{LCV}$, $A_{RCV}$ are still positioned substantially perpendicular to both of the horizontal axis $A_H$ and the coupler axis $A_{CH}$ and positioned substantially parallel to the vertical axis $A_V$.

The second embodiment of the device 1010 is engaged by the user in the same manner as described above in connection with the first embodiment of the device 10. For example, when the device 1010 is in the "ready to use" position: (i) the ball 1015 is connected to the resistance assembly 100, (ii) the hands H of the person or user U are inserted through the opposed tether segments 1030, 1035 and the gaps G to grasp the ball 1015, and (iii) the person's torso is in an initial, neutral, non-rotated position. Also, when the device 1010 is in the "use position" the: (i) ball 1015 is connected to the resistance assembly 100, (ii) person's hands H are inserted through the opposed tether segments 1030, 1035 and into the gaps G to grasp the ball 1010, and (iii) the person has at least partially rotated or pivoted their torso. Then in this user position, the person performs the pivotal torso movement to his/her left, the right hand RH (i) is oriented towards the resistance assembly 100, and (ii) applies a compressive force on the outer ball surface 15*a* that is directed towards the person's left side and away from the resistance assembly 100 and the coupler 40 to move or "drive" the ball 15 to his/her left, while the left hand LH is the "off-hand" and thus is oriented away from the resistance assembly 100 and does not apply a compressive force. Upon completion of a suitable number of repetitions, the person can remove his/her hands H from the gaps G and then reorient himself by walking around the resistance assembly 100 such that his/her left hand LH and left elbow are closest to the coupler 40 secured to the resistance assembly 100 whereupon the person is in the ready to use position for the pivotal torso movement to his/her right.

Figure 14:
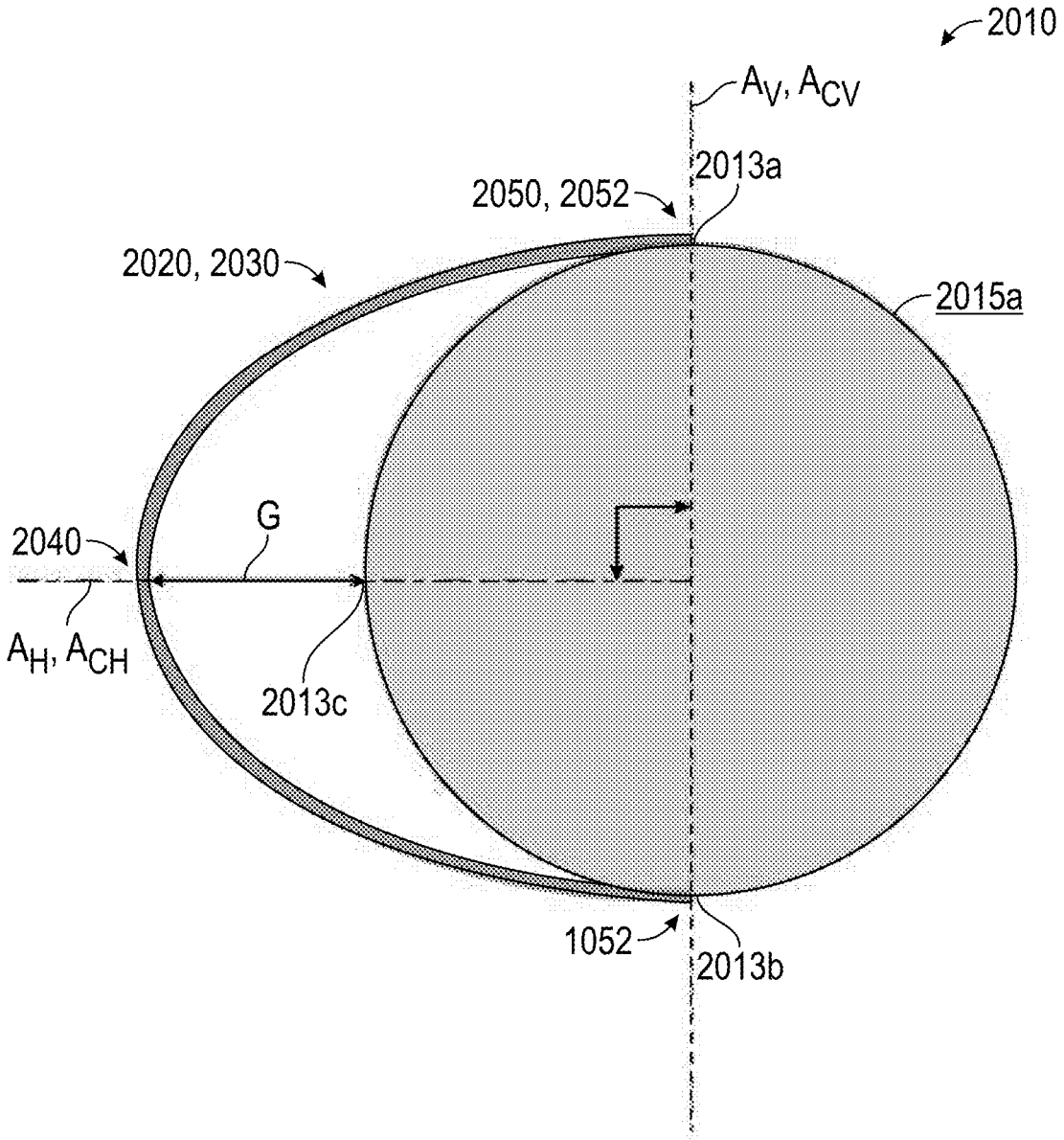
FIG. 14 is a schematic view of a third embodiment of an exercise device for performing a torso rotation movement.
Figure 15:
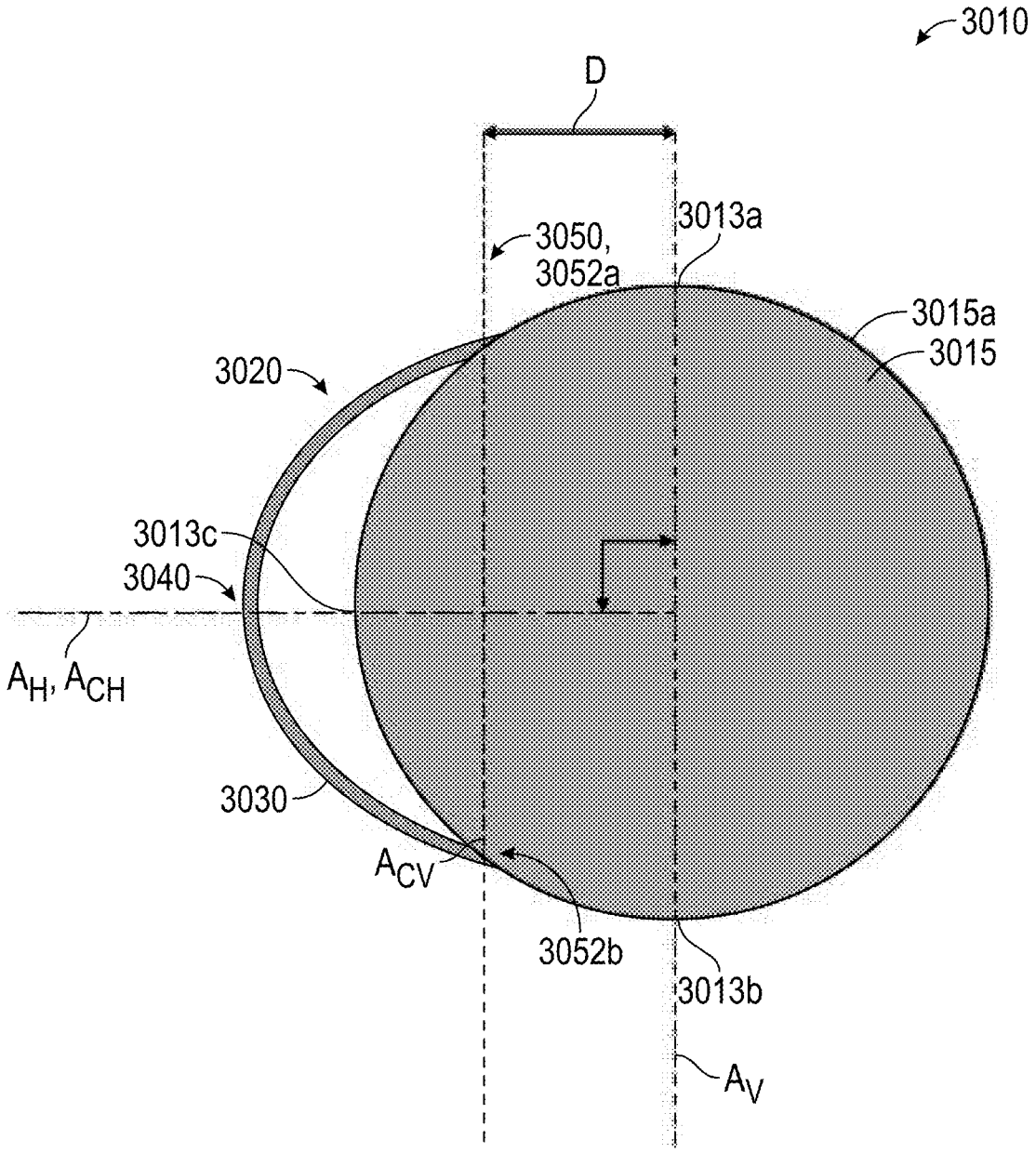
FIG. 15 is a schematic view of a fourth embodiment of an exercise device for performing a torso rotation movement.

A third embodiment of the device 2010 is shown in FIG. 14, which is similar to the first embodiment of the device 10 shown in FIGS. 1-8. Additionally, a fourth embodiment of the device 3010 is shown in FIG. 15, which is similar to the second embodiment of the device 1010 shown in FIGS. 9-13. For sake of brevity, the above disclosure in connection with device 10 will not be repeated, but it should be understood that like numbers represent like structures. For example, the disclosure relating to ball 15 applies in equal force to ball 2015, 3015.

Unlike the first and second embodiments of the device 10, 1010, the third and fourth embodiments of the device 2010, 3010 are not symmetric along the vertical axis $A_V$. However, the third and fourth embodiments of the device 2010, 3010 are still symmetric along the horizontal axis $A_H$. As such, a top view will match a bottom view, but the front view will not match the back view and one side view will not match the opposed side view. This lack of symmetry along the vertical axis $A_V$ is due to the fact that the tether assembly 2020, 3020 includes only a single tether segment 2030, 3030 that yields a single hand gap G and that provides "unidirectional" connectivity with the resistance assembly 100. In other words, the device 10 does not include a second tether segment 2035, 3035 that is an opposed positional relationship to the first tether segment 2030, 3030. In this alternate embodiment, the complexity of the ball 2015, 3015 is reduced which can reduce the costs of the ball 2015, 3015.

This disclosure contemplates other embodiments of the device 10, 1010, 2010, 3010. For example, the device 10, 1010, 2010, 3010 may replace the ball 15 with a different 3-dimensional shape, such as an oval, cone, cylinder, cube or multi-sided prism. In another example, the tether assembly 20, 1020, 2020, 3020 may not be integrally formed or permanently attached to the ball 15, 1015, 2015, 3015 and instead may be designed to be added or retrofitted onto an existing ball 15, 1015, 2015, 3015. As such, this alternative version of the tether assembly 4020 may be manufactured and marketed as a "retrofit kit." In this manner, the retrofit tether assembly 4020 may have an adjustable configuration where the ball 15, 1015, 2015, 3015 is inserted into the tether assembly 4020 and then the tether assembly 4020 is adjusted to secure the tether assembly 4020 to the ball 15, 1015, 2015, 3015.

In a further embodiment, the tether segments 30, 35 may be adjustable which allows the user U to increase or decrease the size and configuration of the gap G that is formed between the ball 15, 1015, 2015, 3015 and the tether segments 30, 35, 1030, 1035, 2030, 3030; thereby allowing people with smaller or larger hands to utilize the device 10, 1010, 2010, 3010. Also, in another embodiment, the device 10, 1010, 2010, 3010 may have an internal storage compartment that is configured to receive a weight, an extent of a resistance assembly, or additional/alternative connectors 40, 1040, 2040, 3040. If the internal storage compartment is configured to receive a weight, then the device 10, 1010, 2010, 3010 could be configured in a manner that allows the user to adjust the weight of the device 10, 1010, 2010, 3010 by inserting weights of different amounts within the ball 15, 1015, 2015, 3015. In even further embodiments, the ball 15, 1015, 2015, 3015 may have indentations that are configured to receive the user's fingers and/or the ball 15, 1015, 2015, 3015 may be deflatable.

Phrases such as an aspect, the aspect, another aspect, some aspects, one or more aspects, an implementation, the implementation, another implementation, some implementations, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only and should not be taken as limiting the scope of the disclosure.

What is claimed is:

1. An exercise device used by a person to perform abdominal muscle exercises, the exercise device comprising:

a handheld, weighted ball;

a tether assembly affixed to the ball, the tether assembly having: both a first flexible tether segment affixed to an outer surface of the ball by a top connector assembly and a bottom connector assembly and a second flexible tether segment affixed to the outer surface of the ball by the top connector assembly and the bottom connector assembly, and wherein (i) the top and bottom connector assemblies are arranged 180 degrees apart from each other, and (ii) each of the first and second flexible tether segments define a gap between said outer surface and the flexible tether segment, the gap being dimensioned to receive a hand of the person while performing the abdominal muscle exercises and a coupler extending from each of the flexible tether segments for operable connection to a resistance assembly.

2. The exercise device of claim 1, wherein the resistance assembly is a machine with a selectable weight stack or weight plates.

3. The exercise device of claim 1, wherein the tether assembly is configured to ensure that forces generated by the resistance assembly remain properly focused and the ball remains balanced and resists uncomfortable twisting motion while being held by the person performing the abdominal exercise movements.

4. The exercise device of claim 1, wherein when the weighted ball is being held by the person, the person's right hand resides within the gap and is oriented closest to a resistance assembly when performing the abdominal muscle exercises to the person's left side.

5. The exercise device of claim 1, wherein each of the couplers are oriented 90 degrees from each of the top connector assembly and the bottom connector assembly.

6. The exercise device of claim 1, wherein the couplers are arranged 180 degrees apart from each other.

7. The exercise device of claim 1, wherein the couplers reside along a coupler axis that extends through a center of the ball.

8. The exercise device of claim 7, wherein the coupler axis is co-linear with a horizontal axis that extends through the center of the ball.

9. The exercise device of claim 7, wherein when the device is in a ready to use position, the coupler axis is co-linear with a resistance assembly axis that extends through the resistance assembly proximate the ball.

10. The exercise device of claim 9, wherein when the device is in a use position, the coupler axis is not co-linear with the resistance assembly axis.

11. The exercise device of claim 1, wherein in a use position: (i) the weighted ball is connected to the resistance assembly through the operable connection of the coupler to the resistance assembly, (ii) the person grasps the ball while his/her hands are inserted into the gaps, and (iii) the person pivots his/her torso through a range of motion to train the abdominal muscles, where the resistance assembly increases the amount of work performed by the person during the exercise.

12. The exercise device of claim 11, wherein in the use position, the person's forearms extend at a substantially 90 degree angle from the person's torso.

13. The exercise device of claim 11, wherein in the use position, the person's forearms are oriented substantially perpendicular to the person's spinal column.

14. The exercise device of claim 11, wherein the resistance assembly is an elastically deformable member that provides elastic resistance during the the abdominal muscle exercises.

15. An exercise device used by a person to perform abdominal muscle exercises, the exercise device comprising:

a handheld, weighted ball;

a tether assembly affixed to the ball, the tether assembly having: both a first flexible tether segment affixed to an outer surface of the ball by a top connector assembly and a bottom connector assembly and a second flexible tether segment affixed to the outer surface of the ball by the top connector assembly and the bottom connector assembly, and wherein (i) the top and bottom connector assemblies reside along a connector axis that extends through a center of the ball, and (ii) each of the first and second flexible tether segments define a gap between said outer surface and the flexible tether segment, the gap being dimensioned to receive a hand of the person while performing the abdominal muscle exercises; and, a coupler extending from each of the flexible tether segments for operable connection to a resistance assembly.

16. The exercise device of claim 15, wherein the couplers reside along a coupler axis that extends through the center of the ball; and wherein the connector axis is oriented perpendicular to the coupler axis.

17. The exercise device of claim 15, wherein the connector axis is co-linear with a vertical axis that extends through the center of the ball.

18. The exercise device of claim 15, wherein when the device is in a ready to use position, the connector axis is perpendicular with a resistance assembly axis that extends through the resistance assembly proximate the ball.

19. The exercise device of claim 15, wherein in a use position: (i) the weighted ball is connected to the resistance assembly through the operable connection of the coupler to the resistance assembly, (ii) the person grasps the ball while his/her hands are inserted into the gaps, and (iii) the person pivots his/her torso through a range of motion to train the abdominal muscles, where the resistance assembly increases the amount of work performed by the person during the exercise.

20. The exercise device of claim 19, wherein when the device is in the use position, the connector axis is perpendicular with floor.

21. The exercise device of claim 15, wherein the tether assembly is configured to ensure that forces generated by the resistance assembly remain properly focused and the ball remains balanced and resists undesirable twisting motion while being held by the person performing the abdominal exercise movements.

22. The exercise device of claim 15, wherein when the weighted ball is being held by the person, the person's right hand resides within the gap and is oriented closest to the resistance assembly when performing the abdominal muscle exercises to the person's left side.

* * * * *